US005494210A

United States Patent [19]

Suzuki

[11] Patent Number: 5,494,210

[45] Date of Patent: Feb. 27, 1996

[54] SAVING BOX

[75] Inventor: Tooru Suzuki, Tokyo, Japan

[73] Assignee: Tenyo Co., Ltd., Tokyo, Japan

[21] Appl. No.: 334,336

[22] Filed: Nov. 2, 1994

[30] Foreign Application Priority Data

Nov. 8, 1993 [JP] Japan ..... 5-059877 U

[51] Int. Cl.[6] ..... A47G 29/00

[52] U.S. Cl. ..... 232/4 R; D99/37; 446/10

[58] Field of Search ..... 232/1 D, 4 R; D99/34, 35, 36; 446/8, 9, 10

[56] References Cited

U.S. PATENT DOCUMENTS 496,393 5/1893 Barton ..... 232/4 R 519,643 5/1894 Reynolds ..... 446/10

2,667,011 1/1954 Glass et al. ..... 446/9

*Primary Examiner*—Michael J. Milano

*Attorney, Agent, or Firm*—Sixbey, Friedman, Leedom & Ferguson; Gerald J. Ferguson, Jr.

[57] ABSTRACT

A savings box comprises a main body and a control box. The main body is provided with a coin slot and shutter plate. A magnet is fixed on the shutter plate and another magnet is fixed on a control member (slider) provided inside the control box. The coin slot is closed by the shutter plate while the control member (T-bar) is placed at the first position due to the reaction between the two magnets. When the T-bar is moved to the second position with a coin placed on the shutter plate, that is, in the coin slot, the reaction between the two magnets will cause the shutter plate to turn and leave under the coin slot, thus the coin falls into the main body of the savings box. The coin is automatically accepted into the main body synchronously with the operation of the T-bar.

12 Claims, 7 Drawing Sheets

SAVING BOX

The present invention relates to a savings box, and more particularly to a savings box comprising a main body thereof and a control box disposed apart therefrom and which has a control member fitted therein, the control member being to be operated for automatically accepting a coin into the main body.

SUMMARY OF THE INVENTION

The present invention has an object to provide a savings box comprising a main body and a control box disposed as spaced therefrom as if they had nothing to do with each other and which has a control member fitted therein, the control member being to be operated for automatically accepting into the main body a coin which is set in a coin slot formed in the main body.

The savings box according to the present invention comprises a main body having a coin slot formed therein, a control box disposed as spaced from the main body, a shutter plate pivotably provided in the main body to close and open the coin slot, a control member provided for the control box and which can be moved between a first and second positions, and a pair of magnets one of which is fixed on the shutter plate and the other is on the control member, the magnets being adapted to rotate the shutter plate to a place where it closes the coin slot when the control member is placed at the first position while rotating the shutter plate away from the coin slot when the control member is moved to the second position, so that the coin slot will open, thus a coin set in the coin slot falling into the main body through the coin slot.

In the savings box according to the present invention, a coin is set in the coin slot (on the shutter plate) with the control member placed at the first position and so the coin slot closed with the shutter plate. In this condition, the control member is moved to the second position. The magnets at the shutter plate side and a one on the control member side react with each other so that the shutter plate is rotated away from the coin slot. The coin set in the coin slot (on the shutter plate) will fall into the main body through the coin slot. Thereafter, when the control member is moved back to the first position, the magnets react with each other again to rotate the shutter plate which in turn will close the coin slot. The main body and control box of the savings box are thus disposed appearing as if they had no mutual connection between them. However, the automatic acceptance of a coin set in the coin slot into the main body seems synchronized with the operation of the control member in the control box.

DETAILED DESCRIPTION OF THE PREFERRED EMBODIMENTS

Figure 1:
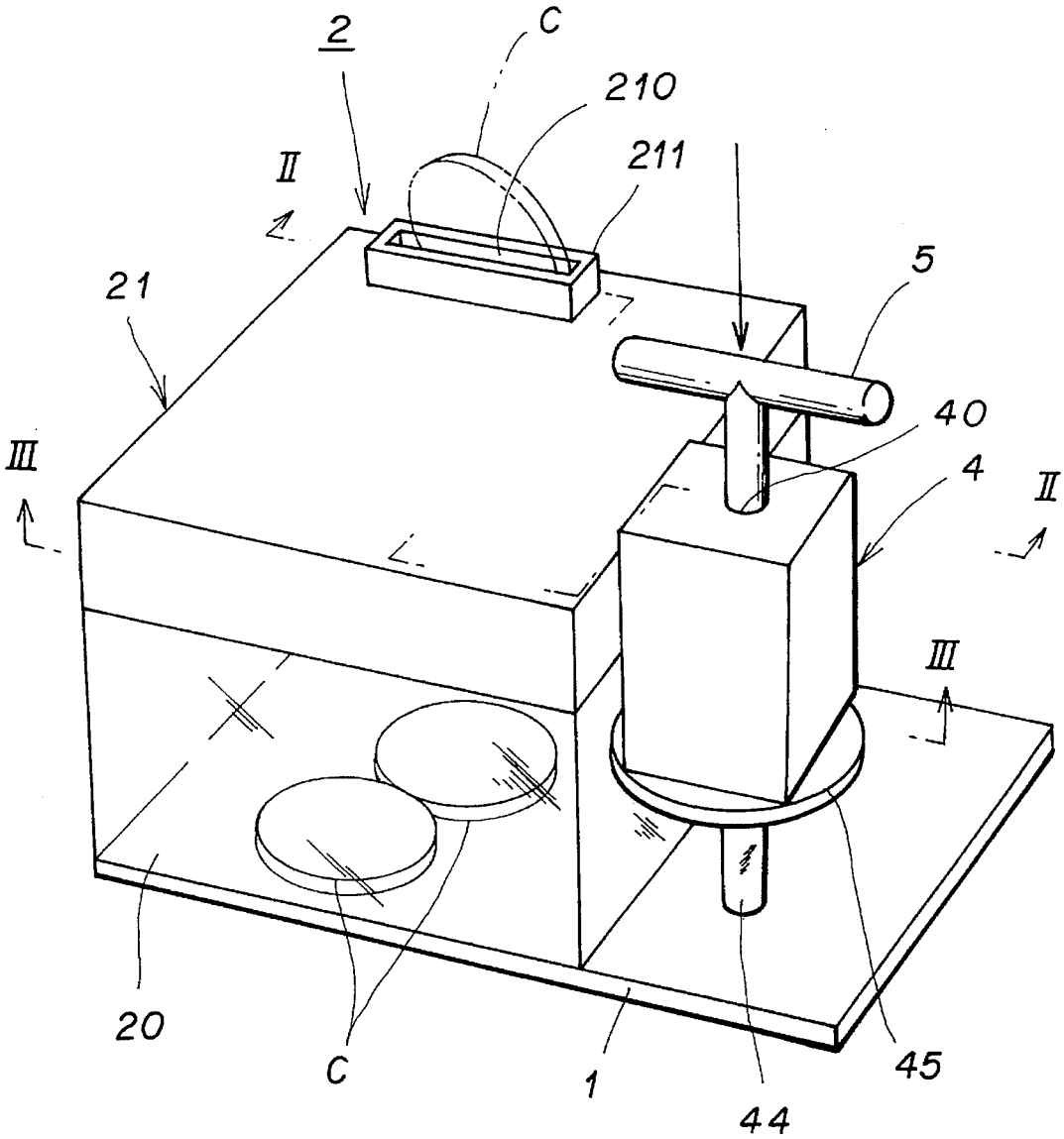
FIG. 1 is a perspective view of a first embodiment of the savings box according to the present invention, in which the control member is placed at the first position where the shutter plate closes the coin slot and a coin is put on the shutter plate.

Referring now to the drawings, two preferred ones of the savings box according to the present invention will be described herebelow. FIGS. 1 through 7 show together the first embodiment of the savings box according to the present invention.

As shown, the savings box according to the present invention consists of a main body 2 for acceptance of coins C and which is composed of a base plate 1, box-like structure 20 and a lid 21.

The base plate 1 is made of a synthetic resin, for example, and has a rectangular shape.

The box-like structure 20 is also made of a synthetic resin, for example, and shaped as a hollow rectangular parallelepiped open at both the top and bottom thereof. The box-like structure 20 is fixed at the bottom thereof on the base plate 1 as positioned at the one end of the latter.

The lid 21 is made of a synthetic resin, for example, and shaped as a hollow rectangular parallelepiped open at the bottom thereof and of which the planer shape is generally identical to that of the box-like structure 20. The lid 21 is operably mounted at one bottom side thereof to one top side of the box-like structure 20. Otherwise, the lid 21 is fixed at the bottom thereof to the top of the box-like structure 20.

The lid 21 has formed in the top thereof a rectangular coin slot 210 which has a riser 211 formed integrally on and along it. The riser 211 is provided to vertically support a coin C set in the coin slot 210.

Figure 5:
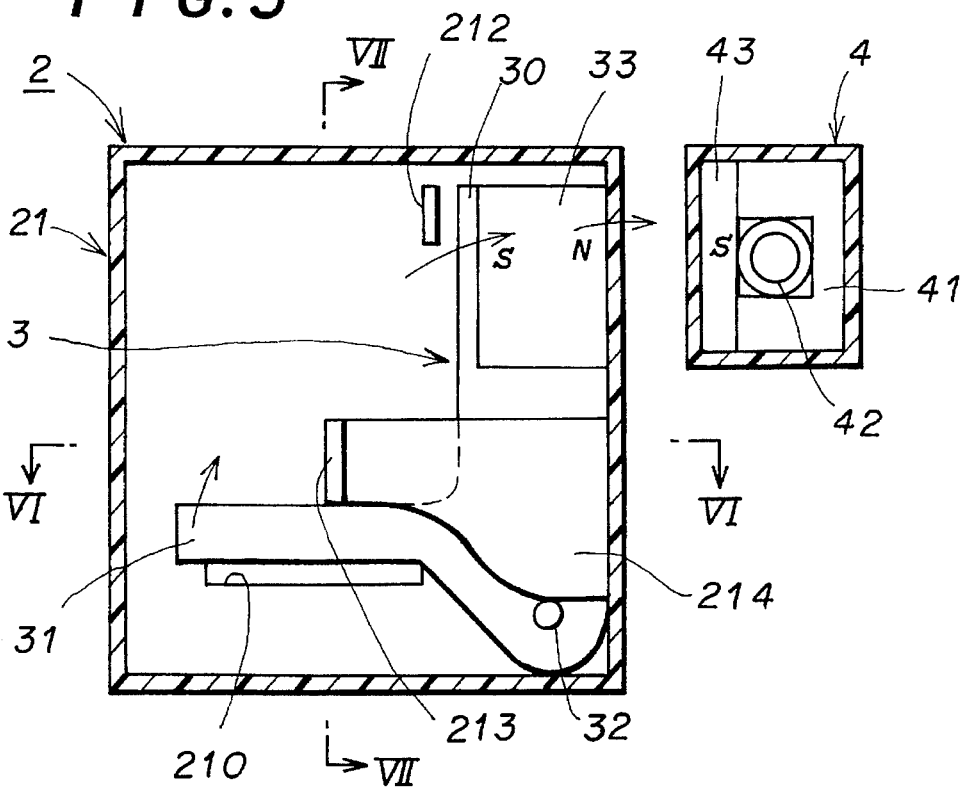
FIG. 5 is a sectional view taken at a similar position to that in FIG. 3, in which the control member is placed at the second position where the shutter plate is away from the coin slot and the coin has fallen into the main body.
Figure 6:
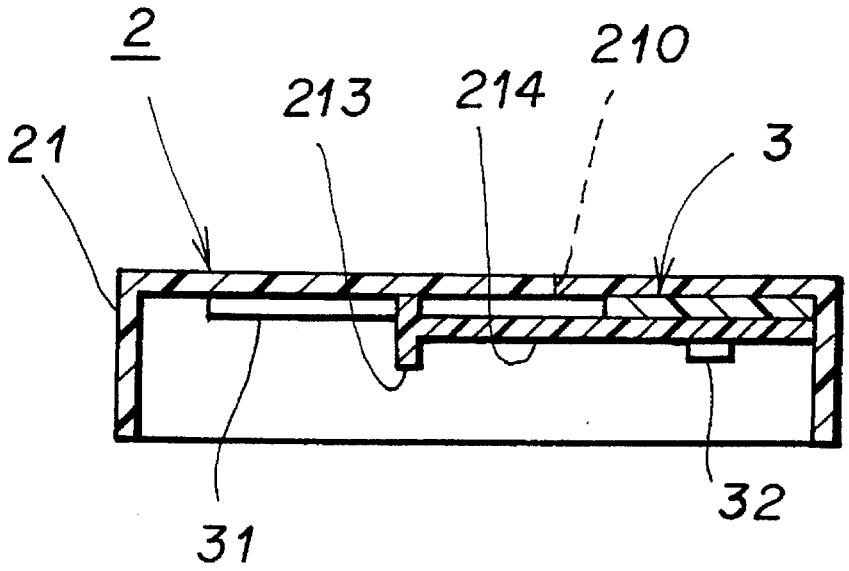
FIG. 6 is a sectional view taken along the line VI—VI in FIG. 5.
Figure 7:
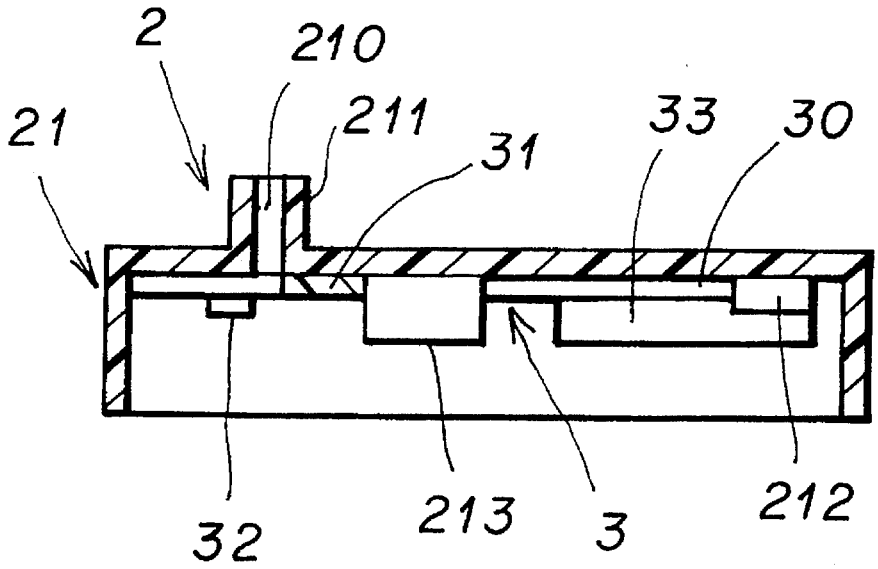
FIG. 7 is a sectional view taken along the line VII—VII in FIG. 5.

The savings box according to the present invention further comprises a shutter plate 3 pivotably provided to close and open the coin slot 210. The shutter plate 3 is made of a synthetic resin, for example, and consists of a main portion 30 and a coin slot closing portion 31 which form together a general shape of "L". The shutter plate 3 is pivotably secured at the intermediate portion thereof under the lid 21 by means of a pivot 32. As shown in FIG. 6, the intermediate portion of the shutter plate 3 is held between the lid 21 and a retaining plate 214 fixed to the lid 21. The shutter plate 3 is pivotable between a first and second stops 212 and 213 fixed to the lid 21. As seen from FIG. 3, while the main portion 30 of the shutter plate 3 is abutting the first stop 212, the portion 31 thereof closes the coin slot 210. Also as shown in FIG. 5, while the main portion 30 is abutting the second stop 213, the portion 31 is away from the coin slot 210.

Further, the savings box according to the present invention comprises a control box 4 made of an opaque synthetic resin, for example, and has the shape of a hollow rectangular parallelepiped. The control box 4 is disposed on the base plate 1 on which the main body 2 is also fixed, but as spaced from the main body 2 of the savings box. More particularly, the control box 4 is fixed on a disk 45 made of a transparent synthetic resin, for example. The control box 4 is also provided under the disk 45 with a cylindrical support column 44 made of a transparent synthetic resin, for example, and which is fixed at the lower end thereof on the base plate 1 at the end portion opposite to the other end portion where the main body 2 is fixed. These base plate 1, support column 44 and disk 5 are so disposed that the distance between the control box 4 and main body 2 (especially the box-like structure 20) is such that there will take place a mutual magnetic reaction between two magnets one in the control box 4 and the other in the main body 2 of the savings box as will be described later. Also the control box 4 is so disposed as to be opposite to a portion of the main body 2 of the savings box in which the main portion 30 of the shutter plate 3 is located.

Furthermore, the control box 4 is provided with a slider 41 as a control member. The slider 41 is so housed in the control box 4 as to be slidable vertically between a first position (topmost position) and second position (bottommost position). A compression spring 42 is provided between the bottom face of the slider 41 and the bottom of the control box 4 to normally force the slider 41 toward its first position.

The control box 4 is further provided with a "T-shaped" bar 5 also as another control member to operate the slider 41. The T-bar 5 is made of a transparent synthetic resin, for example. This T-bar 5 is used as vertically slid into a circular through-hole 40 formed in the top of the control box 4.

The reference numerals 33 and 43 denote a magnet at the shutter plate side and a one at the control box side, respectively. The magnet 33 is fixed to the main portion 30 of the shutter plate 3 inside the main unit 2, and the magnet 43 is fixed on a lateral inner wall of the slider 41 inside the control box 4, that is opposite to the location of the magnet 33 on the shutter plate 3 inside the main body 2 of the savings box. The magnet 33 on the shutter plate 3 is disposed with the north (N) pole thereof positioned at the outer side (nearer and opposite to the control box 4) and the south (S) pole at the inner side (farther from the control box 4), while the magnet 43 on the slider 4 is disposed with the S pole thereof positioned at the upper portion of the slider 4 and the N pole at the lower portion. Thus, when the T-bar 5 is placed at the first position, the N pole of the magnet 33 on the shutter plate 3 inside the main body 2 is opposite to the N pole of the magnet 43 on the slider 41 inside the control box 4.

Figure 2:
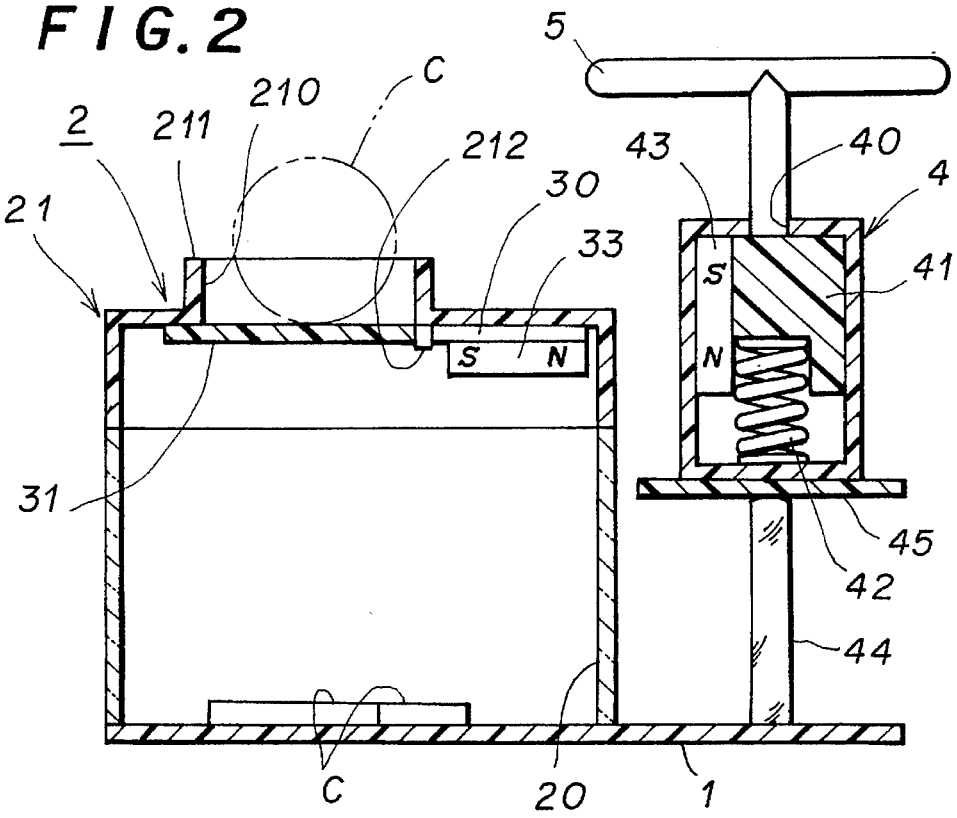
FIG. 2 is a sectional view taken along the line II—II in FIG. 1.
Figure 3:
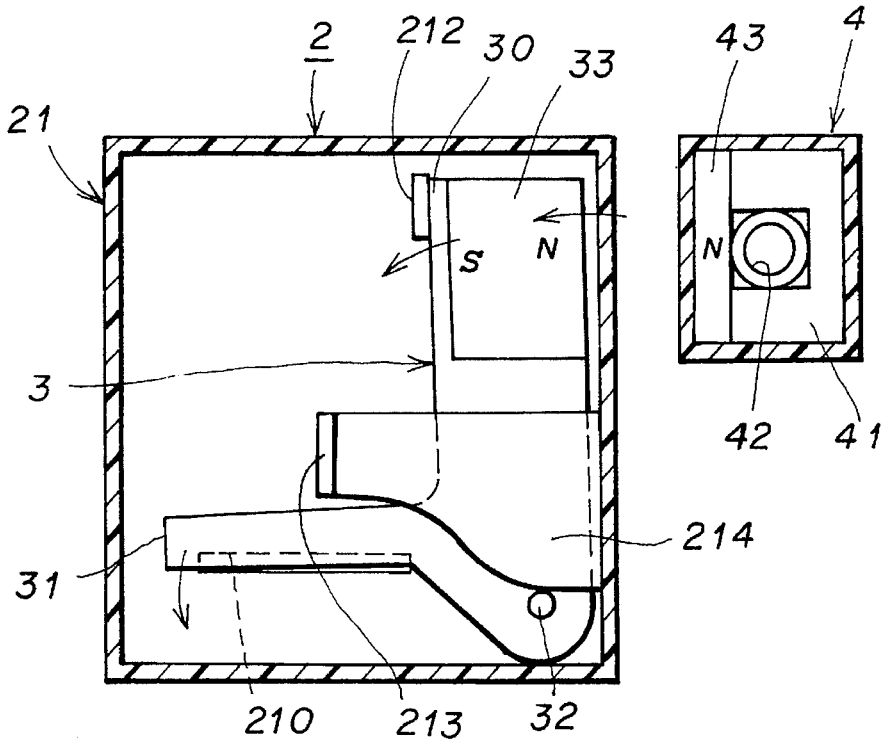
FIG. 3 is a sectional view taken along the line III—III in FIG. 1.

The savings box according to the present invention is configured as having been discussed in the foregoing, and it is to be used as will be described below:

First in the normal status, the slider 41 is forced to its first position under the action of the compression spring 42 inside the control box 4 as shown in FIGS. 1 through 3. Owing to the repulsion between the N pole of the magnet 33 on the shutter plate 3 inside the main body 2 and the N pole of the magnet 43 on the slider 41 inside the control box 4, these poles being opposite to each other in this status, the shutter plate 3 is turned about the pivot 32 in the direction of arrow (counterclockwise) in FIG. 3 and thus the main portion 30 thereof is moved to abut the first stop 212 while the coin slot closing portion 31 is taken to the coin slot 210 in the main body 2 of the savings box and closes the coin slot 210.

When inserted into the riser 211 around the coin slot 210 in the main body 2 of the savings box, a coin C gets on the coin slot closing portion 31 of the shutter plate 3 and stays there standing upright from the riser 211 as shown in FIGS. 1 and 2.

Figure 4:
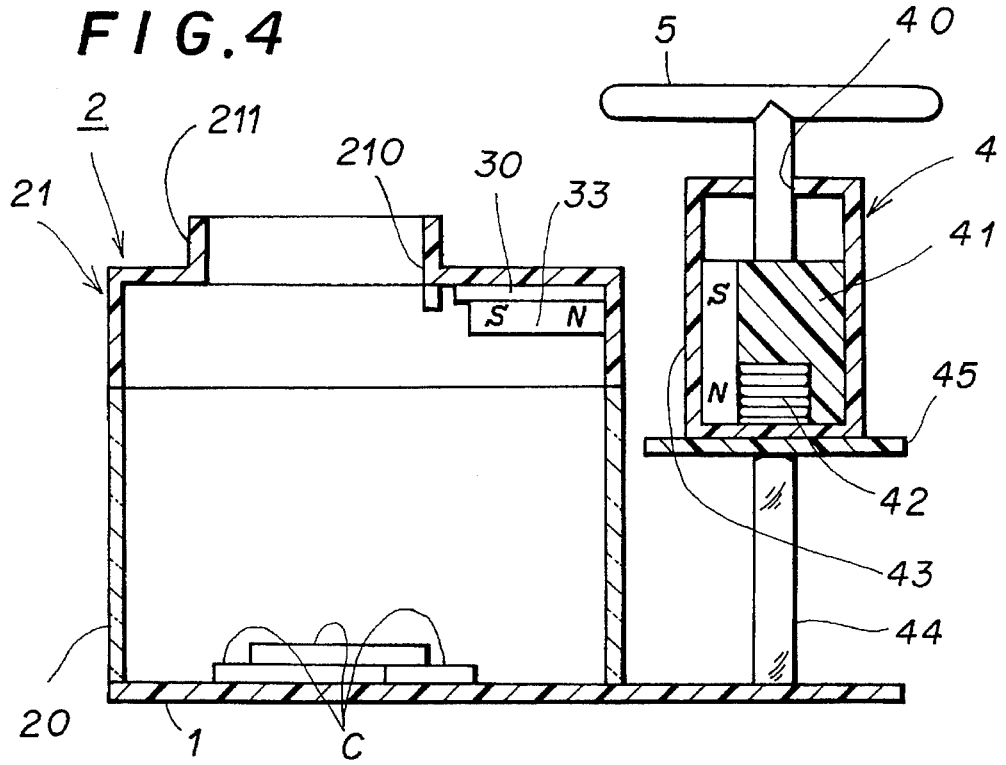
FIG. 4 is a sectional view taken at a similar position to that in FIG. 2, in which the control member is placed at the second position where the shutter plate is away from the coin slot and the coin has fallen into the main body.

Then, the T-bar 5 is inserted into the through-hole 40 in the control box 4 until it abuts the top of the slider 41 as shown in FIG. 4. The T-bar 5 is pushed down in the direction of arrow against the force of the compression spring 42 to move the slider 41 to its second position. Then, the N pole of the magnet 33 on the shutter plate 3 in the main body 2 of the savings box will attract the S pole of the magnet 43 on the slider 4 inside the control box 4 so that the shutter plate 3 will be turned about the pivot 32 in the direction of arrow (clockwise) in FIG. 5. The coin slot closing portion 31 of the shutter plate 3 will abut the second stop 213 and leave under the coin slot 210. Now the coin slot 210 is opened. As a result, the coin C on the portion 31 of the shutter plate 3 will fall into the box-like structure 20 of the main body 2 of the savings box through the coin slot 210 as shown in FIG. 4.

When the T-bar 5 is stopped from being pressed and removed from in the control box 4, the resilience of the compression spring 42 will cause the slider 41 to go back to the first position. At this time, the shutter plate 3 is turned counterclockwise due to the repulsion between the two magnets 33 and 43, and closes the coin slot 210.

Since the main body 2 of the savings box and the control box 4 are disposed as spaced from each other on the base plate 1, they seem as if there were no direct relation between the main body 2 and control box 4. By operating the T-bar 5 set in the control box 4, a coin C is automatically dropped into the main body 2 of the savings box synchronously with the operation of the T-bar 5.

In the first embodiment having been described in the foregoing, the box-like structure 2 of the savings box main body 2 and the cylindrical column 44 of the control box 4 are made of a transparent material so that the apparent mutual independence between the main body 2 and control box 4 can be much enhanced. Note that the box-like structure 20 and cylindrical column 44 may be made of an opaque material.

It should be noted that the first embodiment may be so adapted that the T-bar 5 is slid otherwise, that is, horizontally or obliquely.

The T-bar 5 may be fixed at the bottom thereof to the top of the slider 41.

FIGS. 8 through 12 show together the second embodiment of the savings box according to the present invention. The same elements in these FIGURES as those in FIGS. 1 through 7 are indicated with the same reference numerals.

The reference numeral 6 indicates a rotary control member. The control member 6 is a "T-shaped" bar made of an opaque synthetic resin, for example. The control member 6 has a vertical rotary portion 62 fitted in a through-hole 40 formed in the top center of the control box 4 and also a through-hole 46 formed in the bottom center of the control box 4 and which is rotatable between a first and second positions. A magnet 63 is fixed on a portion of the rotary shaft 62 of the control member 6 that is housed in the control box 4. The magnet 63 is so disposed on the rotary shaft 62 that its N or S pole can be placed with respect to the magnet 33 on the shutter plate 3 when the rotary shaft 62 is rotated.

In this embodiment, a position in which the S pole of the magnet 63 on the control member 6 is opposite to the N pole of the magnet 33 on the shutter plate 3, is taken as the first position of the control member 6, while a position in which the N pole of the magnet 63 on the control member 6 is opposite to the N pole of the magnet 33 on the shutter plate 3, is taken as the second position of the control member 6.

Normally the control member 6 is placed at the first position under the action of attraction between the S pole of the magnet 63 on the control member 6 and the N pole of the magnet 33 on the shutter plate 3.

Figure 8:
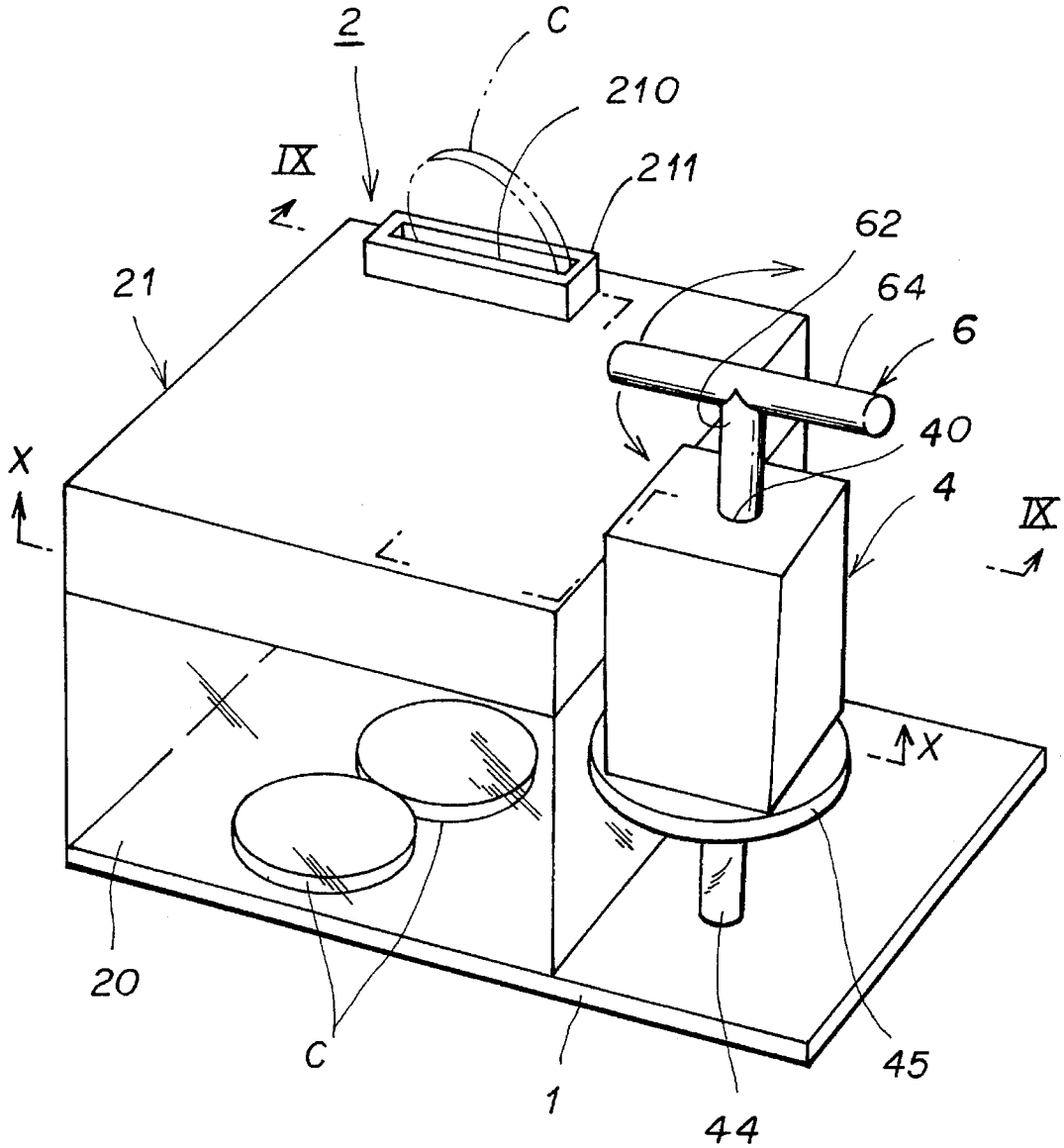
FIG. 8 is a perspective view of a second embodiment of the savings box according to the present invention, in which the control member is placed at the first position where the shutter plate closes the coin slot and a coin is put on the shutter plate.
Figure 9:
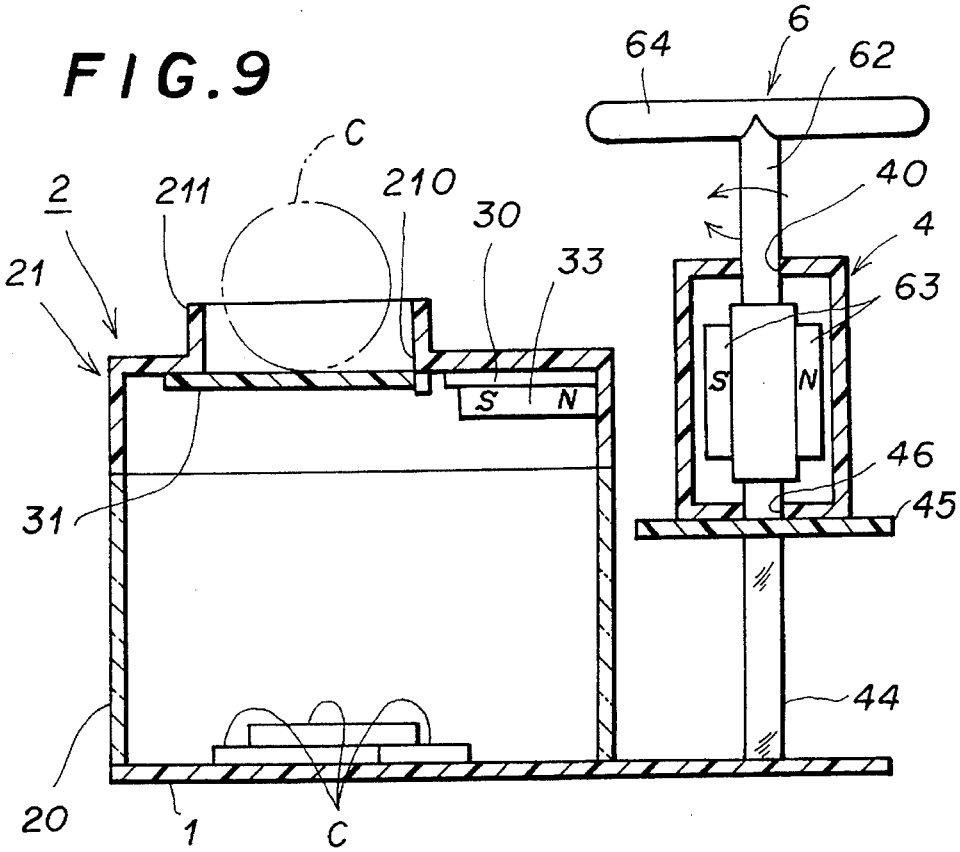
FIG. 9 is a sectional view taken along the line IX—IX in FIG. 8.
Figure 10:
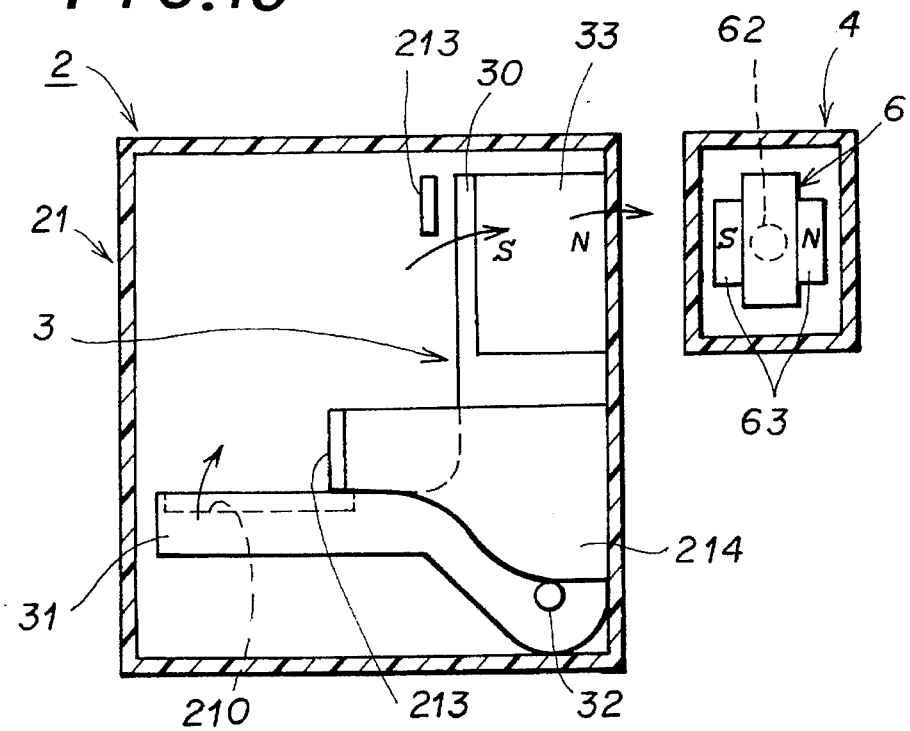
FIG. 10 is a sectional view taken along the line X—X in FIG. 8.

The second embodiment of the savings box according to the present invention is configured as having been discussed in the foregoing, and it is to be used as will be described below:

First in the normal status, the control member 6 is placed at the first position as shown in FIGS. 8 through 10. Under the attraction between the N pole of the magnet 33 on the shutter plate 3 inside the main body 2 and the S pole of the magnet 63 on the control member 6 inside the control box 4, these poles being opposite to each other in this status, the shutter plate 3 is turned about the pivot 32 in the direction of arrow (clockwise) in FIG. 10 so that the coin slot closing portion 31 of the shutter plate 3 abuts the first stop 213 and is taken to the coin slot 210 in the main body 2 of the savings box to close the coin slot 210.

When inserted into the riser 211 around the coin slot 210 in the main body 2 of the savings box, a coin C gets on the coin slot closing portion 31 of the shutter plate 3 and stays there standing upright from the riser 211 as shown in FIGS. 8 and 9.

Figure 11:
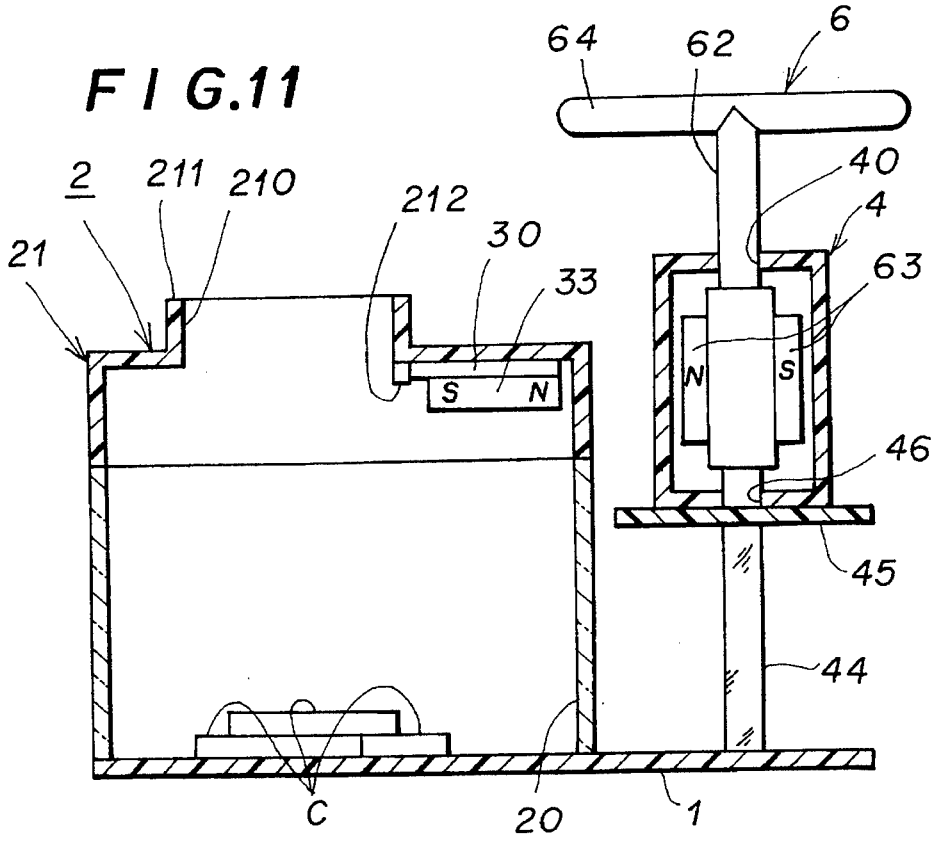
FIG. 11 is a sectional view taken at a similar position to that in FIG. 9, in which the control member is placed at the second position where the shutter plate is away from the coin slot and the coin has fallen into the main body.
Figure 12:
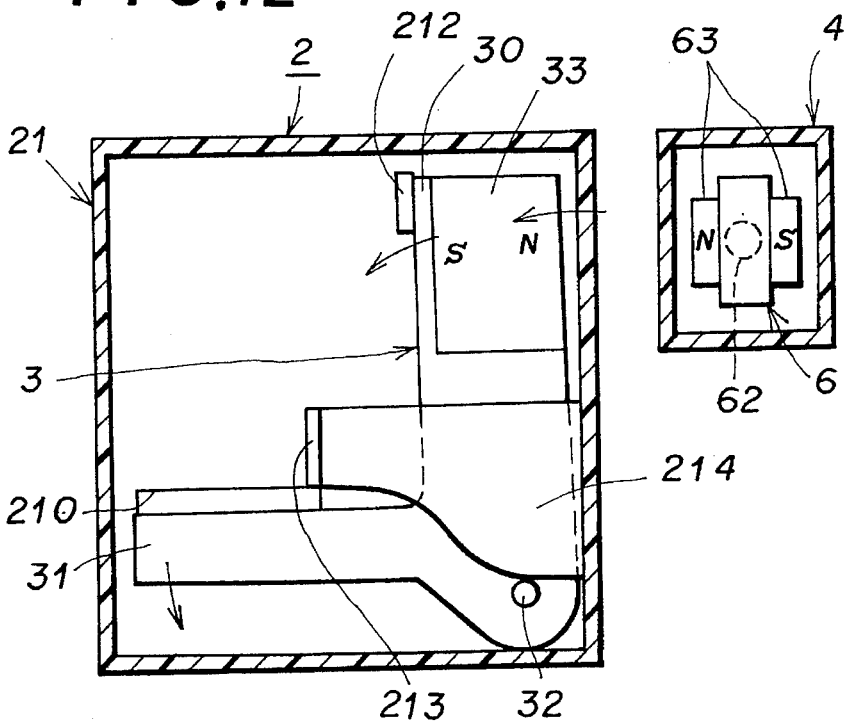
FIG. 12 is a sectional view taken at a similar position to that in FIG. 10, in which the control member is placed at the second position where the shutter plate is away from the coin slot and the coin has fallen into the main body.

Then, a horizontal control bar 64 of the control member 6 is held in hand or otherwise and turned generally 180° in the direction of arrow (clockwise or counterclockwise) to the second position against the attraction between the magnets 33 and 63 as shown in FIG. 8. There occurs a repulsion between the N pole of the magnet 33 on the shutter plate 3 and the S pole of the magnet 63 on the control member 6 to turn the shutter plate 3 about the pivot 32 in the direction of arrow (counterclockwise) as in FIG. 12 until the main portion 30 of the shutter plate 3 abuts the first stop 212 while the coin slot closing portion 31 of the shutter plate 3 leaves under the coin slot 210. Now the coin slot 210 is opened. As a result, the coin C on the portion 31 of the shutter plate 3 will fall into the box-like structure 20 of the main body 2 of the savings box through the coin slot 210 as shown in FIG. 11.

When the hand is taken off the control bar 64, the repulsion and attraction between the two magnets 33 and 63 will cause the control bar 64 to automatically go back to the first position. At this time, the shutter plate 3 will be turned clockwise and the portion 31 thereof will close the coin slot 210.

The second embodiment of the savings box can thus provide a same effect as the first embodiment can do.

The control members (slider 41 and T-bar 5) in the first embodiment are adapted to be slidable while the control member 6 in the second embodiment is rotatable. These control members may be of an oscillatory type.

The correlation between the repulsion or attraction between the two magnets 33 and 43 (or 63) and the operation (closing and opening) of the shutter plate 3 is not limited to those involved in the aforementioned embodiments.

Stoppers may be provided for the control members (slider 41 and T-bar 5; 6) for an accurate placement of the control members at the first and second positions, respectively.

Furthermore, the shape of the T-bar 5 and control member 6 is not limited to the "T" shape in the embodiments, but may be "sagittal", for example.

The coin slot 210 may be covered with, for example, a pyramid-shaped roof in which there is formed an opening communicating with the coin slot 210.

In addition, there may be provided a light emitting element or a sounding element, which is activated when the control member is operated.

The control member may be provided with a pretty doll or the like to further enhance the apparent independence between the main body 2 and control box 4.

What is claimed is:

1. A savings box, comprising:

a main body having a coin slot formed therein;

a control box disposed apart from said main body;

a shutter plate pivotably provided in said main body to close and open said coin slot;

a control member provided for said control box and which can be moved between a first and second positions; and a pair of magnets one of which is fixed on said shutter plate and the other is on said control member, said magnets being adapted to rotate said shutter plate to a place where it closes said coin slot when said control member is placed at the first position while rotating said shutter plate away from said coin slot when said control member is moved to the second position, so that said coin slot will open, thus a coin set in said coin slot falling into said main body through said coin slot.

2. A savings box as set forth in claim 1, wherein said control member is provided in said control box slidably between the first and second positions and there is provided between said control member and box a resilient member which normally forces said control member toward the first position.

3. A savings box as set forth in claim 1, wherein said control member is provided in said control box rotatably between the first and second positions and is normally placed at the first position under the reaction between the magnet on said control member and the magnet on said shutter plate.

4. A savings box as set forth in claim 1, wherein said main body is transparent at least at a portion thereof in which coins are to be accepted.

5. A savings box as set forth in claim 2, wherein said main body is transparent at least at a portion thereof in which coins are to be accepted.

6. A savings box as set forth in claim 3, wherein said main body is transparent at least at a portion thereof in which coins are to be accepted.

7. A savings box as set forth in claim 1, wherein said main body and control box are connected to each other with a member of which at least a portion is transparent.

8. A savings box as set forth in claim 2, wherein said main body and control box are connected to each other with a member of which at least a portion is transparent.

9. A savings box as set forth in claim 3, wherein said main body and control box are connected to each other with a member of which at least a portion is transparent.

10. A savings box as set forth in claim 1, wherein said main body is provided with a means of vertically supporting a coin set in said coin slot being closed by said shutter plate.

11. A savings box as set forth in claim 2, wherein said main body is provided with a means of vertically supporting a coin set in said coin slot being closed by said shutter plate.

12. A savings box as set forth in claim 3, wherein said main body is provided with a means of vertically supporting a coin set in said coin slot being closed by said shutter plate.

* * * * *